US009773607B2

(12) United States Patent
Zhang et al.

(10) Patent No.: US 9,773,607 B2
(45) Date of Patent: Sep. 26, 2017

(54) COIL WITH VARIABLE INNER DIAMETER AND ELECTRONIC MODULE MADE FROM THE COIL

(71) Applicant: Sumida Electric (H.K.) Company Limited, Hong Kong (CN)

(72) Inventors: Hongnian Zhang, Hong Kong (CN); Douglas James Malcolm, Algonquin, IL (US); Yanfei Liu, Kingston (CA)

(73) Assignee: Sumida Electric (H.K.) Company Limited, Hong Kong (HK)

( * ) Notice: Subject to any disclaimer, the term of this patent is extended or adjusted under 35 U.S.C. 154(b) by 163 days.

(21) Appl. No.: 14/265,649

(22) Filed: Apr. 30, 2014

(65) Prior Publication Data

US 2014/0328027 A1 Nov. 6, 2014

(30) Foreign Application Priority Data

May 3, 2013 (CN) ..... 2013 1 0160759

(51) Int. Cl.
*H01F 5/00* (2006.01)
*H01F 27/28* (2006.01)

(52) U.S. Cl.
CPC ..... *H01F 27/2823* (2013.01); *H01F 5/00* (2013.01); *H01F 27/2828* (2013.01)

(58) Field of Classification Search
CPC ..... H01F 5/00; H01F 27/00–27/30
USPC ..... 336/65, 83, 200, 232
See application file for complete search history.

(56) References Cited

U.S. PATENT DOCUMENTS 5,831,331 A * 11/1998 Lee ..... H01L 23/645 257/277
6,169,470 B1 * 1/2001 Ibata ..... H01F 17/0006 336/200
6,975,200 B2 * 12/2005 Nakao ..... H01F 19/08 336/200

(Continued)

FOREIGN PATENT DOCUMENTS

CN 2726076 Y 9/2005
CN 101515498 A 8/2009

(Continued)

OTHER PUBLICATIONS

Search Report and First Office Action for Priority Chinese Patent Appl. No. 201310160759.1 mailed on Jan. 26, 2016.

(Continued)

*Primary Examiner* — Tuyen Nguyen
(74) *Attorney, Agent, or Firm* — Seyfarth Shaw LLP

(57) ABSTRACT

A coil with variable inner diameter is disclosed. The coil includes a coil body consisting of a plurality of turns of winding, and a connecting terminal configured to be connected to an external device, wherein the winding is wound to form at least two different inner diameters. And an electronic module made from the coil with variable inner diameter is also disclosed. The electronic module includes: electronic components including at least an integrated circuit chip; a coil with variable inner diameter, including a coil body having at least two different inner diameters and a connecting terminal; a connector, configured to be electrically connected with the electronic component and the coil; and a magnetic conductor, configured to enclose in and around the coil body and the electronic component.

11 Claims, 1 Drawing Sheet

(56) References Cited

U.S. PATENT DOCUMENTS

| | | | | |
|---|---|---|---|---|
| 8,350,659 | B2 * | 1/2013 | Dziubek | H01F 27/303 336/205 |
| 2002/0153985 | A1 | 10/2002 | Hirohashi et al. | |
| 2004/0090298 | A1 * | 5/2004 | Masu | H01F 17/0006 336/200 |
| 2006/0284719 | A1 * | 12/2006 | Lee | H01F 17/0013 336/223 |
| 2009/0315662 | A1 * | 12/2009 | Hijioka | H01F 17/0013 336/200 |
| 2012/0025940 | A1 | 2/2012 | Kikuchi et al. | |
| 2013/0200977 | A1 * | 8/2013 | Miyazaki | H05K 1/185 336/192 |
| 2013/0234285 | A1 | 9/2013 | Hijioka et al. | |

FOREIGN PATENT DOCUMENTS

| | | | |
|---|---|---|---|
| CN | 101523526 | A | 9/2009 |
| CN | 102347127 | A | 2/2012 |
| CN | 102893344 | A | 1/2013 |

OTHER PUBLICATIONS

Supplemental Search Report & Second Office Action for Priority Chinese Patent Appl. No. 201310160759.1, mailed on Aug. 17, 2016.

* cited by examiner

COIL WITH VARIABLE INNER DIAMETER AND ELECTRONIC MODULE MADE FROM THE COIL

FIELD OF THE INVENTION

The present disclosure relates generally to the field of coil technology, and specifically to a coil with variable inner diameter and an electronic module made from the coil.

BACKGROUND OF THE INVENTION

With today's rapid development of electronic products, coil has been almost applied to every field, as an essential electronic device. For example, SMD (Surface Mounting Devices) coils are widely used in products like common mode filters, high frequency transformer, impedance transformers, balanced and unbalance transformers, devices for restraining electromagnetic interference (EMI), USB circuits of personal computer and peripheral equipment, liquid crystal display panel, low voltage differential signal devices and car remote keys; closed magnetic circuit high current surface mounting power inductors are widely used in products like video cassette recorder power supplies, LCD TVs, laptops, office automation equipments, mobile communication equipments and AC/DC Converter; RF inductors are widely used in products like mobile telephones, VCO or TCXO circuit and RF transceiver modules, global positioning system, blue tooth modules, communication equipments, LCD TVs, cameras, notebook computers, inkjet printers, photocopier, display monitors, game machines, color televisions, video cassette recorders, optical drives, digital cameras and automotive electronics products; fixed inductance coils are widely used in network, telecommunications, computers, alternating current power supplies and peripheral equipments. Particularly, the fixed inductance coil is most common and most widely used.

Meanwhile, with the development of miniaturization and integration in the electronic industry, requirements on volumes occupied by various electronic devices become higher and higher. However, since the inner diameter of a coil in the prior art is uniform (as shown in FIG. 1), it is apparently unable to achieve an optimized use of a space to be occupied by the coil when a product with the space is to be designed in a special shape, which restricts the performance of the coil and does not contribute to the development of miniaturization of electronic products.

In addition, researches show that the performance of the fixed inductance coil such as impedance, sensitivity, linear range and electromotive force generated from it, has a close relationship with the inner diameter of the coil, namely, the size of the inner diameter of the coil directly affect the performance of the fixed inductance coil. During the production manufacturing of electronic products, a fixed electronic product may need coils with different performances to meet the requirement of function variety, or a coil needs to be changed to a coil with a different performance to meet the upgrade of the product. In this case, for a coil with an uniform inner diameter in the prior art, it needs to replace the whole coil or even abandon the whole electronic product, which will undoubtedly make a big waste of materials and bring an increase in production cost.

SUMMARY OF THE INVENTION

In order to solve the above problems in the prior art, the object of the present disclosure is to provide a coil with variable inner diameter and an electronic module made from the coil.

According to an aspect of the present disclosure, a coil with variable inner diameter includes a coil body consisting of a plurality of turns of winding, and a connecting terminals configured to be connected to an external device, where the winding is wound to form at least two different inner diameters.

Preferably, the winding can be a flat wire or a round wire.

Preferably, the inner diameter has a round, square, polygonal or oval shape.

According to another aspect of the present disclosure, an electronic module made from the coil with variable inner diameter includes:

electronic components, including at least an integrated circuit chip;

a coil with variable inner diameter, including a coil body having at least two different inner diameters and a connecting terminal;

a connector, configured to be electrically connected with the electronic component and the coil with variable inner diameter; and a magnetic conductor, configured to enclose in and around the coil body and the electronic component.

Preferably, the electronic component also includes a resistance and/or a capacitance.

Preferably, the winding of the coil body can be formed by a flat wire or a round wire.

Preferably, the inner diameter of the coil has a round, square, polygonal or oval shape.

Preferably, the connector can be a printed circuit board or a lead frame.

Preferably, the connector also includes a terminal configured to be connected to an external device.

Preferably, the magnetic conductor is formed from magnetic powder by an encapsulating approach.

Preferably, the encapsulating approach can be molding or potting.

With the above technical solution of the present disclosure, the occupied volume can be optimized even for a product to be design in a special shape, and the present disclosure also can reduce the waste of materials and production cost.

DETAILED DESCRIPTION OF THE INVENTION

The present disclosure may be best understood by reference to the following description taken in conjunction with embodiments and reference to the accompanying drawings.

Figure 1:
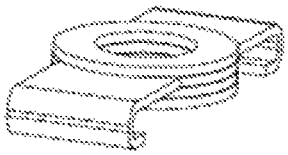
FIG. 1 is a schematic diagram illustrating a coil in the prior art.
Figure 2:
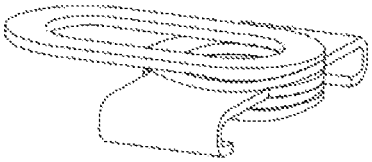
FIG. 2 is a schematic diagram illustrating a coil according to one embodiment of the present disclosure.

According to an aspect of the present disclosure, a coil with variable inner diameter is provided. As shown in FIG. 2, in one embodiment of the present disclosure, the coil with variable inner diameter includes a coil body consisting of a plurality of turns of winding, and a connecting terminal configured to be connected to an external device, where the coil is formed with at least two different inner diameters.

Wherein, the winding can be formed by a flat wire or a round wire.

Wherein, the inner diameter of the winding has a round, square, polygonal, oval shape or other shape.

In this way, for a product to be designed in a special shape, the coil with variable inner diameter can either meet design requirements on a product in special shape or optimize the volume occupied by the product. Meanwhile, the coil with variable inner diameter can easily meet electronic products upgrades, and reduce the waste of coils and other materials, to reduce production cost.

Figure 3:
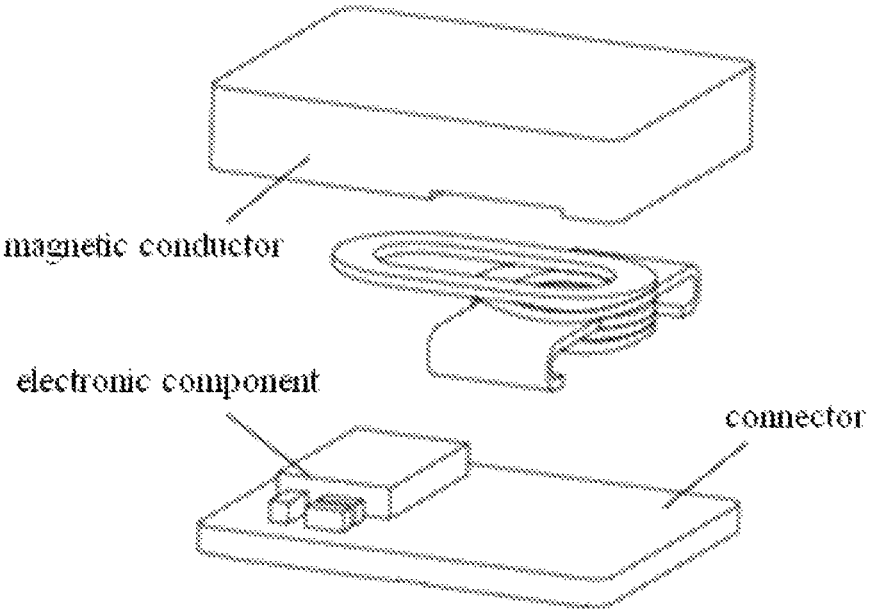
FIG. 3 is a schematic diagram illustrating an electronic module made from the coil according to one embodiment of the present disclosure.

According to another aspect of the present disclosure, it also provides an electronic module made from the coil with variable inner diameter. As shown in FIG. 3, in one embodiment of the present disclosure, the integrated circuit chip is a unit module integrated a MOSFET, a drive circuit, a pulse width modulator and a controller. One advantage of such configuration is to fully utilize the space available and give largest possible space for magnetic components, such as inductor and transformer.

In another embodiment of the present disclosure, the electronic components also includes a resistance, a capacitance or other electronic components.

The coil with variable inner diameter includes a coil body including at least two different inner diameters and a connecting terminal.

Wherein, the winding can be a flat wire, a round wire or a wire in other shapes.

Wherein, the shape of the inner diameter can be round, square, polygonal, oval or other shapes.

The connector is electrically connected with the electronic components and the coil with variable inner diameter.

Optionally, the connector can be a printed circuit board or a lead frame.

In another embodiment of the present disclosure, the connector also includes a terminal configured to be connected with an external device.

The magnetic conductor is configured to enclose in and around the coil body and the electronic component, and can be used as a magnetic core of the coil.

In one embodiment of the present disclosure, the magnetic conductor is formed from magnetic powder by an encapsulating approach, and the encapsulating approach can be molding or potting.

With the above electronic module made from the coil with variable inner diameter, requirements for designing various special products and upgrading the coil device can be better handled, so as to greatly broaden the coil market, and to reduce the waste of coils and other materials and production cost.

The embodiments are chosen and described in order to explain the principles of the disclosure and their practical application so as to activate others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. A coil with a variable inner diameter, comprising:

a coil body including first and second turns of winding disposed on or adjacent to one another and respectively forming first and second inner diameters, wherein a central axis of the first turn of winding extends through the second turn of winding and the first and second turns of winding are partially overlapped in a direction of the central axis; and a connecting terminal configured to be connected to an external device.

2. The coil of claim 1, wherein the first and second turns of winding are formed by a flat wire or a round wire.

3. The coil of claim 1, wherein at least one of the first and second turns of winding has a round, square, polygonal or oval shape.

4. An electronic module, comprising:

an electronic component including an integrated circuit chip;

a coil having a variable inner diameter, the coil including:

a coil body including first and second turns of winding disposed on or adjacent to one another and respectively forming first and second inner diameters, wherein a central axis of the first turn of winding extends through the second turn of winding and the first and second turns of winding are partially overlapped in a direction of the central axis; and a connecting terminal;

a connector configured to be electrically connected with the electronic component and the coil; and a magnetic conductor configured to enclose the coil body and the electronic component.

5. The electronic module of claim 4, wherein the electronic component further includes at least one of a resistance and a capacitance.

6. The electronic module of claim 4, wherein the first and second turns of winding are formed by a flat wire or a round wire.

7. The electronic module of claim 4, wherein at least one of the first and second turns of winding has a round, square, polygonal or oval shape.

8. The electronic module of claim 4, wherein the connector is a printed circuit board or a lead frame.

9. The electronic module of claim 8, wherein the connector further includes a terminal configured to be connected to an external device.

10. The electronic module of claim 4, wherein the magnetic conductor is made from magnetic powder by an encapsulating approach.

11. The electronic module of claim 10, wherein the encapsulating approach is molding or potting.

* * * * *